US008998566B2

(12) United States Patent
Justl et al.

(10) Patent No.: US 8,998,566 B2
(45) Date of Patent: Apr. 7, 2015

(54) BLADE ARRANGEMENT FOR A GAS TURBINE AND METHOD FOR OPERATING SUCH A BLADE ARRANGEMENT

(75) Inventors: Sascha Justl, Zurich (CH); Carlos Simon-Delgado, Baden (CH); Herbert Brandl, Waldshut-Tiengen (DE)

(73) Assignee: Alstom Technology Ltd., Baden (CH)

( * ) Notice: Subject to any disclaimer, the term of this patent is extended or adjusted under 35 U.S.C. 154(b) by 639 days.

(21) Appl. No.: 13/323,558

(22) Filed: Dec. 12, 2011

(65) Prior Publication Data

US 2012/0156035 A1 Jun. 21, 2012

(30) Foreign Application Priority Data

Dec. 21, 2010 (CH) ..... 2141/10

(51) Int. Cl.

| | |
|---|---|
| ***F01D 5/08*** | (2006.01) |
| ***F01D 9/04*** | (2006.01) |
| ***F01D 11/00*** | (2006.01) |
| *F01D 9/06* | (2006.01) |

(52) U.S. Cl.

CPC ..... *F01D 9/042* (2013.01); *F01D 11/005* (2013.01)

(58) Field of Classification Search

CPC ..... F01D 9/042; F01D 9/06; F01D 9/065; F01D 25/08; F01D 25/12; F01D 25/14; F05D 2240/11; F05D 2260/20

USPC ..... 415/115, 116; 416/1, 96 R, 97 R

See application file for complete search history.

(56) References Cited

U.S. PATENT DOCUMENTS

| | | | | |
|---|---|---|---|---|
| 5,332,360 | A | 7/1994 | Correia et al. | |
| 5,630,700 | A * | 5/1997 | Olsen et al. | 415/134 |
| 5,639,216 | A * | 6/1997 | McLaurin et al. | 416/95 |
| 5,797,725 | A | 8/1998 | Rhodes | |
| 7,052,234 | B2 | 5/2006 | Wells et al. | |
| 7,131,817 | B2 * | 11/2006 | Keith et al. | 416/97 R |
| 7,329,087 | B2 | 2/2008 | Cairo et al. | |
| 8,517,680 | B1 * | 8/2013 | Liang | 416/1 |
| 2001/0048878 | A1 * | 12/2001 | Willett et al. | 416/97 R |
| 2006/0269409 | A1 * | 11/2006 | Torii et al. | 416/97 R |
| 2008/0112793 | A1 * | 5/2008 | Lee et al. | 415/115 |
| 2010/0124502 | A1 | 5/2010 | Brandle et al. | |

FOREIGN PATENT DOCUMENTS

| | | | |
|---|---|---|---|
| EP | 1609952 | A1 | 12/2005 |
| EP | 1764481 | A2 | 3/2007 |
| EP | 1795705 | A2 | 6/2007 |

(Continued)

*Primary Examiner* — Edward Look
*Assistant Examiner* — Jason Davis
(74) *Attorney, Agent, or Firm* — Buchanan Ingersoll & Rooney PC

(57) ABSTRACT

A blade arrangement is provided for a gas turbine, in which blade leaves, having a leading edge and a trailing edge and also a pressure side and a suction side, are assembled sealingly with platforms configured as separate components. A peripheral sealing arrangement is provided between the blade leaves and the associated platforms, which seals off an interspace between the blade leaves and platforms against hot gas flowing around the blade leaves. A directed site-dependent supply of cooling air for purging the sealing arrangement is provided on a side of the sealing arrangement which faces away from the hot gas. A method of operating the above blade arrangement is also provided. The method includes supplying cooling air for purging the sealing arrangement at a pressure which decreases from the leading edge of the blade leaves to the trailing edge.

17 Claims, 4 Drawing Sheets

(56) References Cited

FOREIGN PATENT DOCUMENTS

| | | | |
|---|---|---|---|
| EP | 1905956 | A2 | 4/2008 |
| EP | 2189626 | A1 | 5/2010 |
| EP | 2295722 | A1 | 3/2011 |

* cited by examiner

A – A

B – B

B–B

BLADE ARRANGEMENT FOR A GAS TURBINE AND METHOD FOR OPERATING SUCH A BLADE ARRANGEMENT

RELATED APPLICATION

The present application hereby claims priority under 35 U.S.C. Section 119 to Swiss Patent application number 02141/10 filed Dec. 21, 2010, the entire contents of which are hereby incorporated by reference.

FIELD OF INVENTION

The present invention relates to the field of gas turbines. It refers to a built-up blade arrangement for a gas turbine. It refers, furthermore, to a method for operating such a blade arrangement.

BACKGROUND

It has long been known from the prior art to execute moving blades and/or guide vanes of a gas turbine in a built-up or otherwise constructed blade arrangement in which the blade leaves and the upper and/or lower platforms of the blades are formed as separate components which are then assembled in the blade arrangement and sealingly connected.

A guide vane arrangement is shown in U.S. Pat. No. 5,332,360, which is incorporated by reference, shows two guide vanes, which are assembled together with an outer and an inner shroud portion and are soldered to one another along peripheral grooves. Sealing between the blades and shrouds or platforms in this case achieved by means of the soldering itself. A comparable configuration is reproduced in FIG. 1: In the blade arrangement 10 of FIG. 1, two blade leaves 11 are inserted in corresponding openings of two mutually opposite platforms or shroud segments 12 and 13. Each of the blade leaves has a leading edge 14 and a trailing edge 15. The hot gas flowing through the blade leaves 11 between the two platforms 12 and 13 flow in this case from the leading edge 14 to the trailing edge 15. A comparable arrangement is also shown in U.S. Pat. No. 5,797,725, which is incorporated by reference.

Furthermore, U.S. Pat. No. 7,052,234, which is incorporated by reference, shows, in blade arrangements, to combine ceramic blade leaves with metallic platforms or shrouds and to seal off the interspaces between the blade leaves and platforms by means of special seals. However, directed leakages of cooling air may also be used, as shown in U.S. Pat. No. 7,329,087, which is incorporated by reference, in order to prevent hot gas from penetrating into the interspaces between the ceramic blade leaves and the metallic platforms.

U.S. Patent Application Publication No. 2010/124502, which is incorporated by reference, shows to produce the blade leaf and blade platform as separate components and to assemble them, so as to decouple the two parts mechanically. In this case, too, specific seals have to be provided between the components in order avoid the penetration of hot gas.

In most cases, it is necessary, in addition to installing a simple linear sealing arrangement around the blade leaf, to purge this sealing arrangement also from the rear side with cooling air which is under a corresponding pressure higher than the pressure of the hot gas, but identical along the entire sealing arrangement. This means, in particular, that the pressure of the purging air is the same on the pressure side of the blade leaf as on the suction side, where, in fact, less pressure is required on account of the lower pressure in hot gas. This leads to a higher and needless consumption of cooling air in those regions of the blade leaf or of the sealing arrangement where a lower pressure would be sufficient. This then also applies to the leading edge and the trailing edge of the blade leaf where different pressure conditions prevail in the hot gas.

SUMMARY

The present disclosure is directed to a blade arrangement for a gas turbine, in which blade leaves, having a leading edge and a trailing edge and also a pressure side and a suction side, are assembled sealingly with platforms configured as separate components. A peripheral sealing arrangement is provided between the blade leaves and the associated platforms, which seals off an interspace between the blade leaves and platforms against hot gas flowing around the blade leaves. A directed site-dependent supply of cooling air for purging the sealing arrangement is provided on a side of the sealing arrangement which faces away from the hot gas.

The present disclosure is also directed to a method of operating the above blade arrangement. The method includes supplying cooling air for purging the sealing arrangement at a pressure which decreases from the leading edge of the blade leaves to the trailing edge.

BRIEF DESCRIPTION OF THE DRAWINGS

The invention will be explained in more detail below by means of exemplary embodiments, in conjunction with the drawing in which.

DETAILED DESCRIPTION OF THE PREFERRED EMBODIMENTS

Introduction to the Embodiments

Figure 1:
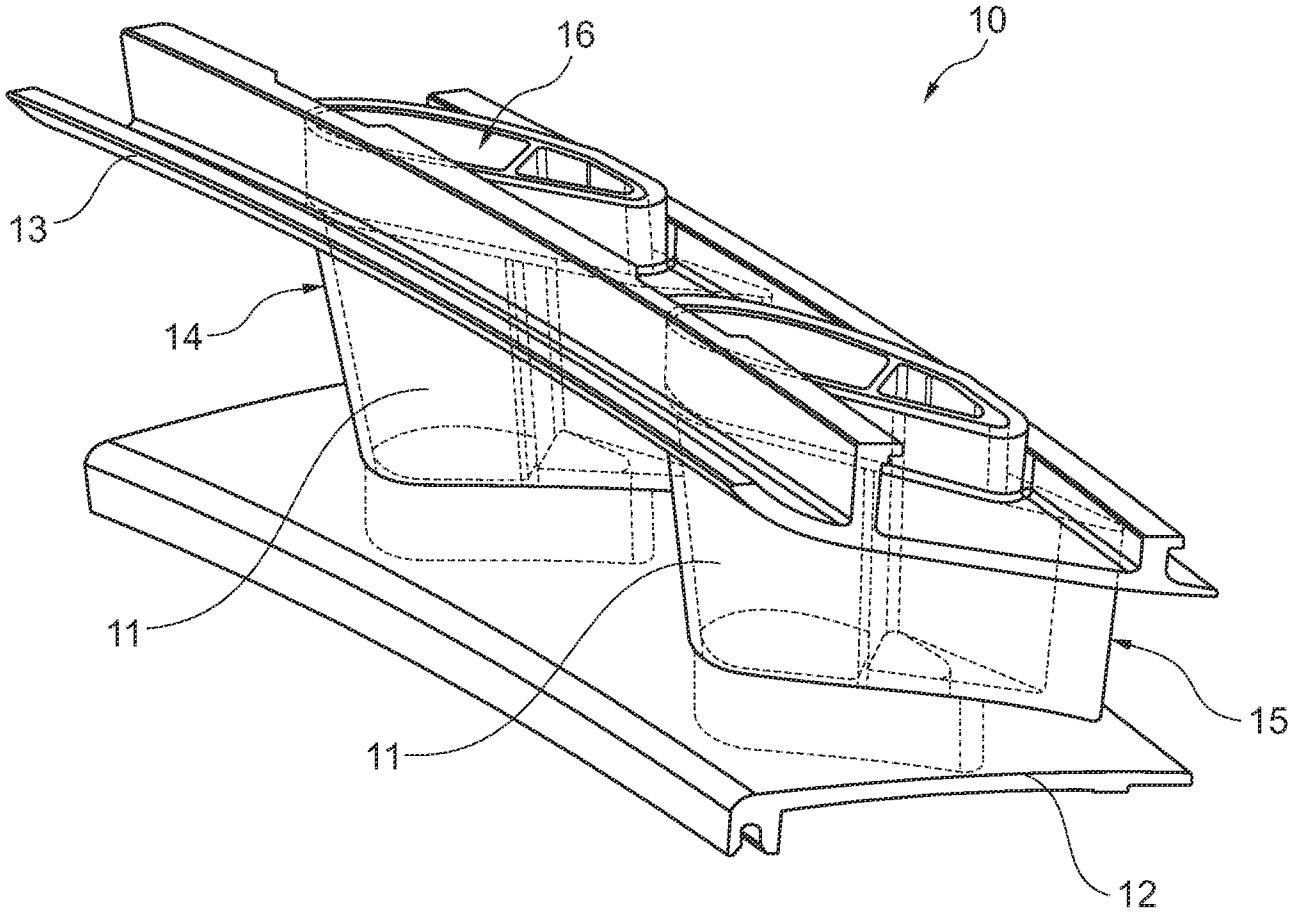
FIG. 1 shows a perspective side view of an exemplary built-up or otherwise constructed blade arrangement in which the invention can be implemented.

An object of the invention, therefore, is to provide a blade arrangement of the type initially mentioned, such that purging of the sealing arrangement with cooling air can take place without a needless consumption of cooling air.

A further object of the invention is to provide a method for operating such a blade arrangement.

In the blade arrangement according to the invention, blade leaves which have a leading edge and a trailing edge and also a pressure side and a suction side are assembled sealingly with platforms designed as separate components, there being provided between the blade leaves and the associated platforms a peripheral sealing arrangement which seals off the interspace between the blade leaves and platforms against the hot gas flowing around the blade leaves.

In the blade arrangement, a directed site-dependent cooling air supply for purging the sealing arrangement is provided on the side of the sealing arrangement which faces away from the hot gas.

In one embodiment of the blade arrangement according to the invention, the cooling air supply comprises cooling ducts which run between the blade leaves and the platforms and into which cooling air is introduced at first selected locations and is discharged at second selected locations and out of which cooling air is administered as purge air to the sealing arrangement.

In particular, the cooling ducts run at a predetermined distance from and essentially parallel to the sealing arrangement.

In another embodiment of the invention, the first selected locations are arranged in the region of the leading edge of the blade leaves, and the second selected locations are arranged at the trailing edge of the blade leaves.

In a further embodiment, a cooling duct is provided, in each case, on the pressure side and on the suction side of the blade leaves, and the cooling ducts of the pressure side are supplied with cooling air independently of the cooling ducts of the suction side.

According to another embodiment, the cooling air for the cooling ducts is delivered from the ends of the blade leaves via the blade leaves.

It is especially advantageous if, in this case, the blade leaves have an inner space leading cooling air in the blade's longitudinal direction, and if the cooling ducts are connected to the inner space via connecting ducts.

According to yet another embodiment of the invention, the cooling air for the cooling ducts is delivered from the respective platforms via connecting ducts.

In the method according to the invention for operating the blade arrangement according to the invention, the supply of cooling air for purging the sealing arrangement takes place at a pressure which decreases from the leading edge of the blade leaves to the trailing edge.

The supply of cooling air for purging the sealing arrangement may in this case take place at a pressure which prevents hot gas from penetrating at the sealing arrangement.

However, the supply of cooling air for purging the sealing arrangement may also take place at a pressure which allows a limited penetration of the hot gas at the sealing arrangement in the region of the leading edge.

DETAILED DESCRIPTION

When the stationary guide vanes or the rotating moving blades of a gas turbine are designed as built-up or otherwise constructed blades, that is to say when the platforms and the blade leaf are decoupled, the gap between the components has to be purged with cooling air in order completely or partially to prevent the penetration of hot gas. The platform and the blade leaf are connected mechanically in a cooler region, that is to say, remotely from the blade leaf/platform transition acted upon by hot gas. However, the nature and placement of this mechanical connection are not the subject of the present application and will therefore not be discussed any further.

The present invention proposes to arrange, between the platform and the blade leaf, cooling ducts which lead into the hot gas duct at the trailing edge of the blade leaf. A sealing arrangement is provided downstream of the cooling ducts toward the hot gas duct in order to seal off the two components against the penetration of hot gas. The cooling ducts function as pressure regulators which regulate the pressure between the sealing arrangement and hot gas.

Thus, a high pressure cooling air may be provided at the leading edge, in the region of the stagnation point of the blade leaf, and decreases toward the trailing edge where less pressure is required for purging. The purging air stream required for the blade arrangement can thereby be minimized. The power output and efficiency of the turbine are improved correspondingly.

Two types of operation are possible in this case:

(1) The selected pressure of the cooling air in the cooling ducts is so high that no hot gas can penetrate at the sealing arrangement.

(2) The pressure of the cooling air in the cooling ducts is reduced to an extent such that hot gas can penetrate at the sealing arrangement to a certain degree, for example in the region of the leading edge of the blade leaf. The geometry of the cooling ducts may allow the entry of hot gas both on the pressure side and on the suction side of the blade leaf. The hot gas entering is then mixed with the cooling air stream and is flushed out of the trailing edge. The controlled penetration of hot gas makes it possible to have a further saving of cooling air, since the supply pressure between the platform and blade leaf can be reduced. A further advantage of the controlled penetration of hot gas is that the temperature gradients in the radial direction in the material are reduced, with the result that thermal stresses are reduced.

As compared with the prior art, by the blade arrangement according to the invention, less cooling air is consumed, and therefore the power output and efficiency of the turbine rise. If, in addition, the penetration of hot gas is accepted to a limited degree, a further improvement arises. It is essential in this case that the pressure by which the cooling air is made available downstream of the sealing arrangement is adapted to the pressure of the hot gas at the blade leaf.

Figure 2:
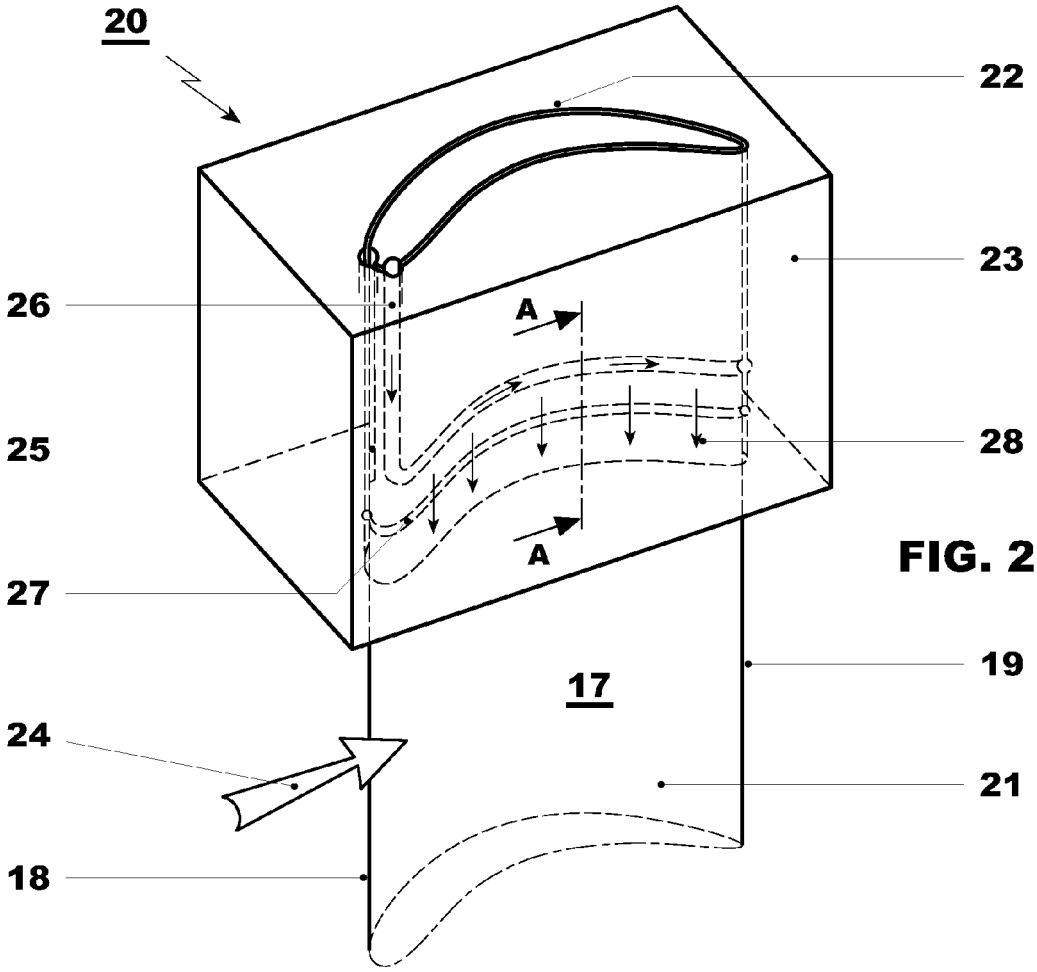
FIG. 2 shows a greatly simplified perspective illustration of a blade according to one exemplary embodiment of the invention, with cooling ducts downstream of the sealing arrangement which are supplied with cooling air separately on the pressure side and the suction side of the blade leaf via the blade leaf.
Figure 3:
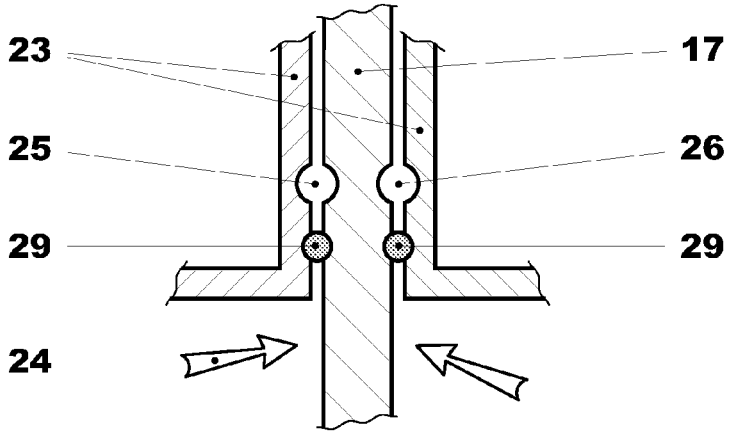
FIG. 3 shows a section through the blade from FIG. 2 along the plane A-A.

FIGS. 2 and 3 illustrate a first exemplary embodiment of the invention. The blade arrangement 20 there comprises a blade leaf 17 which projects with one end into a platform 23 and is sealed off there against the penetration of hot gas 24 by a sealing arrangement 27. The platform 23 is merely indicated; the mechanical connection between the platform 23 and blade leaf 17 is not illustrated. The blade leaf 17 has, as is customary, a leading edge 18, a trailing edge 19, a suction side 22 and a pressure side 21. On that side of the sealing arrangement 27 which faces away from the hot gas 24 in the hot gas duct, cooling ducts 25 and 26 are formed between the platform 23 and blade leaf 17 on the suction side 22 and on the pressure side 21 and, with the exception of the feeds running in the blade's longitudinal direction in the region of the leading edge 18, run parallel to the sealing arrangement 27 which is designed to extend peripherally transversely with respect to the blade's longitudinal direction. FIG. 3 shows in cross section the seals 29 inserted in the sealing arrangement 27 and the cooling ducts 25 and 26 arranged at a distance above these.

As the black arrows depicted in FIG. 2 make clear, cooling air is supplied to the cooling ducts 25 and 26 at the leading edge 18 and flows in the cooling ducts 25 and 26 to the trailing edge 19 where it emerges again. Part of the cooling air 28 enters the cooling ducts 25 and 26 emerges from the cooling ducts 25 and 26 toward the sealing arrangement 27 (in the blade's longitudinal direction) and purges the sealing arrangement 27 so that the entry of hot gas 24 from the other side is prevented or greatly reduced, depending on the pressure employed.

Figure 4:
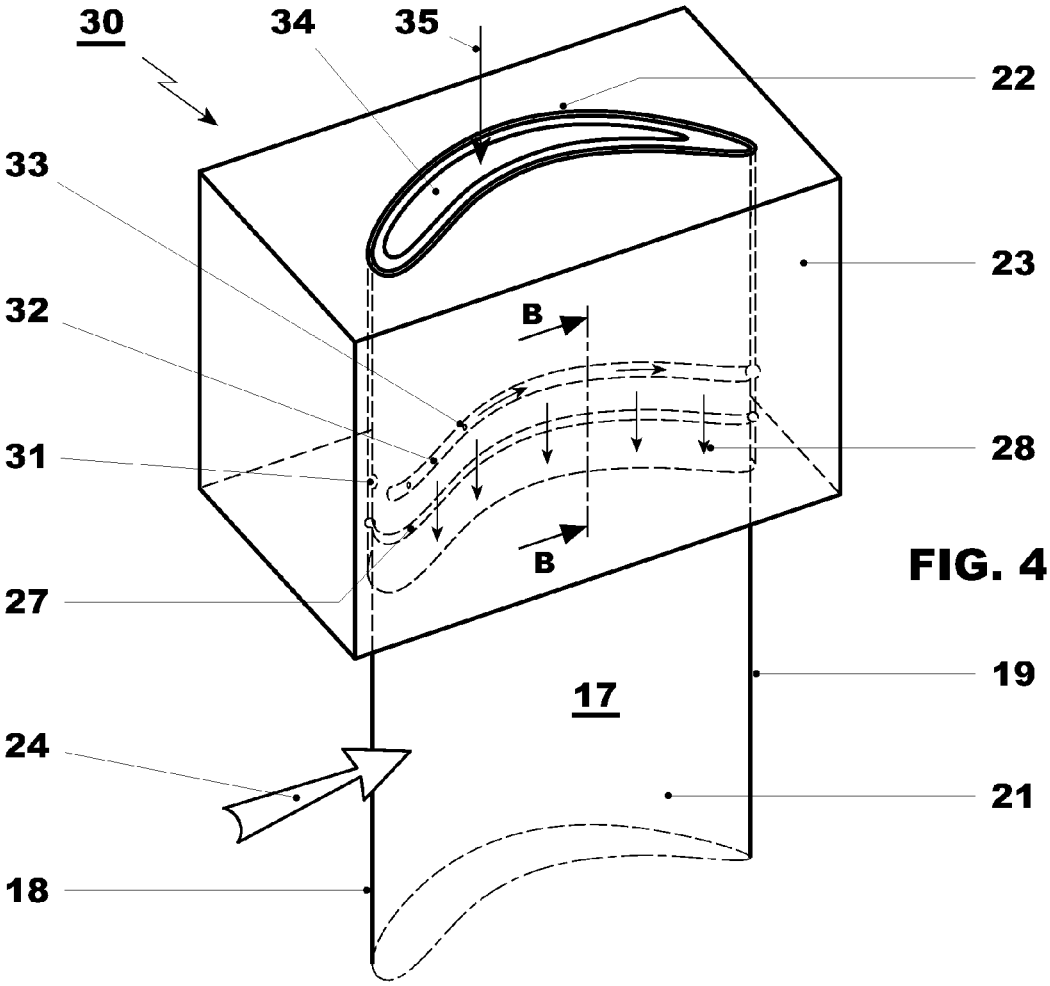
FIG. 4 shows an illustration, comparable to FIG. 2, of a blade according to another exemplary embodiment of the invention, in which the cooling ducts are supplied with cooling air from the inner space of the blade leaf.
Figure 5:
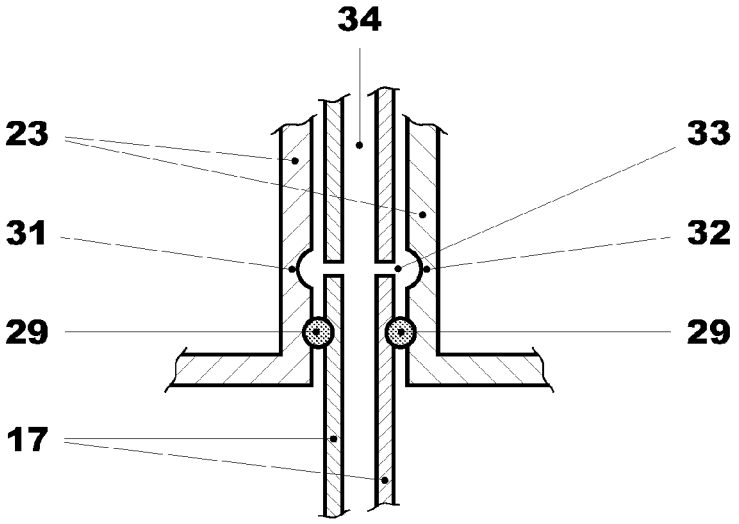
FIG. 5 shows a section through the blade from FIG. 3 along the plane B-B; the section, corresponding to FIG. 3, through the blade from FIG. 4.

A further exemplary embodiment of the blade arrangement according to the invention is shown in FIGS. 4 and 5. Whereas, in the exemplary embodiment of FIG. 2, long ducts for supplying the cooling air have to be introduced into the blade leaf 17 in the blade's longitudinal direction, in the exemplary embodiment of FIG. 4 the supply of cooling air takes place from the hollow inner space 34 of the blade leaf 17 to which cooling air is in any case supplied by means of a cooling air feed 35. In this case, by means of simple short connecting ducts 33 between the cooling ducts 31 and 32 and the inner space 34 of the blade leaf 17 in the region of the leading edge 18, cooling air streams are steered out of the inner space 34 into the cooling ducts 31 and 32 and flow there to the trailing edge 19 where they emerge again. Here, as in the other exemplary embodiments, for the directed and different adjusting of the cooling air streams, throttles may be provided, by means of which the cooling air stream and the pressure drop for each cooling duct can be adjusted individually. These throttles are provided, for example, in the connecting ducts 33, 38 or at the inlet or outlet of the cooling ducts 33, 38 or at the inlet of the cooling ducts 25, 26, 31, 32, 36, 37 or in the cooling ducts 25, 26, 31, 32, 36, 37.

Figure 6:
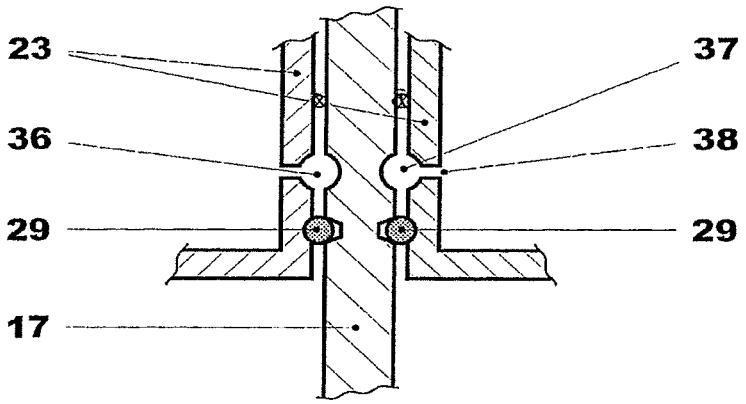
FIG. 6 shows a section B-B, comparable to FIG. 5, through a blade according to a further exemplary embodiment of the invention, in which the cooling ducts are supplied with cooling air from the platform.

However, it is also conceivable, according to FIG. 6, to supply the cooling ducts 36 and 37 with cooling air via short connecting ducts 38 which run between the cooling ducts 36 and 37 and the surrounding platform 23. In this case, cooling air is supplied from corresponding spaces in the platform 23.

The exemplary embodiments discussed here relate to an arrangement of guide vanes. However, the invention may, of course, also be used advantageously in the case of moving blades.

LIST OF REFERENCE SYMBOLS

10, 20, 30 blade arrangement
11, 17 blade leaf
12, 13 platform
14, 18 leading edge
15, 19 trailing edge
16 inner space
21 pressure side
22 suction side
23 platform
24 hot gas
25, 26 cooling duct
27 sealing arrangement
28 cooling air
29 seal
31, 32 cooling duct
33 connecting duct
34 inner space
35 cooling air feed
36, 37 cooling duct
38 connecting duct

What is claimed is:

1. A blade arrangement for a gas turbine, in which comprising:

blade leaves having a leading edge, a trailing edge, a pressure side and a suction side;

platforms configured as separate components, the blade leaves sealingly assembled with respective platforms;

a peripheral sealing arrangement provided between the blade leaves and the respective platforms for sealing off an interspace between the blade leaves and the respective platforms against hot gas flowing around the blade leaves;

a directed site-dependent supply of cooling air for purging the sealing arrangement provided on a side of the sealing arrangement which faces away from the hot gas, wherein the cooling air supply includes cooling ducts which run between the blade leaves and the respective platforms.

2. The blade arrangement as claimed in claim 1, wherein the cooling air is introduced into the cooling ducts at first selected locations and is discharged at second selected locations and out of which cooling air is administered as purging air to the sealing arrangement.

3. The blade arrangement as claimed in claim 2, wherein the cooling ducts run at a predetermined distance from and parallel to the sealing arrangement.

4. The blade arrangement as claimed in claim 2, wherein the first selected locations are arranged in a region of the leading edge of the blade leaves, and the second selected locations are arranged at the trailing edge of the blade leaves.

5. The blade arrangement as claimed in claim 2, wherein a cooling duct is provided, in each case, on the pressure side and on the suction side of the blade leaves, and the cooling ducts of the pressure side are supplied with cooling air independently of the cooling ducts of the suction side.

6. The blade arrangement as claimed in claim 2, wherein the cooling air for the cooling ducts is delivered from ends of the blade leaves via the blade leaves.

7. The blade arrangement as claimed in claim 6, wherein the blade leaves have an inner space leading cooling air in a longitudinal direction of the blade, and the cooling ducts are connected to the inner space via connecting ducts.

8. The blade arrangement as claimed in claim 2, wherein the cooling air for the cooling ducts is delivered from the respective platforms via connecting ducts.

9. The blade arrangement as claimed in claim 8, further comprising:

throttles, for adjusting the cooling air streams, in the connecting ducts or at the inlet or outlet of the connecting ducts or at the inlet of the cooling ducts or in the cooling ducts, by which the cooling air stream and a pressure drop can be adjusted for each cooling duct.

10. The blade arrangement as claimed in claim 1, wherein a cooling duct is provided, in each case, on the pressure side and on the suction side of the blade leaves, and the cooling ducts of the pressure side are supplied with cooling air independently of the cooling ducts of the suction side.

11. The blade arrangement as claimed in claim 1, wherein the cooling air is introduced into the cooling ducts at first selected locations and is discharged at second selected locations and out of which cooling air is administered as purging air to the sealing arrangement, and the purging takes place at a higher pressure on the pressure side of the blade leaves than on the suction side of the blade leaves.

12. The blade arrangement as claimed in claim 1, wherein the supply of cooling air for purging the sealing arrangement takes place at a pressure which allows a controlled penetration of hot gas at the sealing arrangement in a region of the leading edge.

13. A method for operating a blade arrangement for a gas turbine, including blade leaves, having a leading edge, a trailing edge, a pressure side and a suction side, platforms configured as separate components, the blade leaves sealingly assembled with respective platforms, a peripheral sealing arrangement provided between the blade leaves and the respective platforms for sealing off an interspace between the blade leaves and the respective platforms against gas flowing around the blade leaves, a directed site-dependent supply of cooling air for purging the sealing arrangement provided on a side of the sealing arrangement which faces away from the hot gas, wherein the cooling air supply includes cooling ducts which run between the blade leaves and the respective platforms, the cooling ducts arranged, in each case, on the pressure side and the suction side of each blade leaf, the method comprising:

supplying cooling air to the cooling ducts of the pressure side independently of the cooling air supplied to the suction side; and supplying cooling air for purging the sealing arrangement at a pressure which decreases from the leading edge of the blade leaves to the trailing edge.

14. The method as claimed in claim 13, comprising:

supplying cooling air for purging the sealing arrangement at a pressure for preventing hot gas from penetrating at the sealing arrangement.

15. The method as claimed in claim 13, comprising supplying cooling air for purging the sealing arrangement at a pressure which allows a controlled penetration of hot gas at the sealing arrangement in a region of the leading edge.

16. The method for operating the blade arrangement of claim 13, wherein the cooling air is introduced into the cooling ducts at first selected locations and is discharged at second selected locations and out of which cooling air is administered as purging air to the sealing arrangement;

wherein the purging takes place at a higher pressure on the pressure side of the blade leaves than on the suction side of the blade leaves.

17. A method for operating a blade arrangement for a gas turbine, including blade leaves, having a leading edge, a trailing edge, a pressure side and a suction side, platforms configured as separate components, the blade leaves sealingly assembled with respective platforms, a peripheral sealing arrangement provided between the blade leaves and the associated platforms for sealing off an interspace between the blade leaves and respective platforms against gas flowing around the blade leaves, a directed site-dependent supply of cooling air for purging the sealing arrangement provided on a side of the sealing arrangement which faces away from the hot gas, the method comprising:

supplying cooling air for purging the sealing arrangement at a pressure which decreases from the leading edge of the blade leaves to the trailing edge; and supplying cooling air for purging the sealing arrangement at a pressure which allows a controlled penetration of hot gas at the sealing arrangement in a region of the leading edge.

* * * * *